US010575659B2

(12) United States Patent
Veeneman et al.

(10) Patent No.: US 10,575,659 B2
(45) Date of Patent: Mar. 3, 2020

(54) ACCESS DOOR FOR COOLING DEVICE WITH PRODUCT SPACE

(71) Applicant: POLYPLASTIC GROEP B.V., Rotterdam (NL)

(72) Inventors: Jan Peter Veeneman, Bergschenhoek (NL); Robin Van Den Hooven, Gouda (NL)

(73) Assignee: POLYPLASTIC GROEP B.V., Rotterdam (NL)

( * ) Notice: Subject to any disclaimer, the term of this patent is extended or adjusted under 35 U.S.C. 154(b) by 660 days.

(21) Appl. No.: 14/383,117

(22) PCT Filed: Mar. 6, 2013

(86) PCT No.: PCT/NL2013/050145
§ 371 (c)(1),
(2) Date: Sep. 5, 2014

(87) PCT Pub. No.: WO2013/133707
PCT Pub. Date: Sep. 12, 2013

(65) Prior Publication Data

US 2015/0040599 A1 Feb. 12, 2015

(30) Foreign Application Priority Data

Mar. 6, 2012 (NL) ..... 1039440

(51) Int. Cl.
*A47F 3/04* (2006.01)

(52) U.S. Cl.
CPC ..... *A47F 3/043* (2013.01); *A47F 3/0434* (2013.01)

(58) Field of Classification Search
CPC ..... A47F 3/0434; A47F 3/043; F25D 23/02
USPC ..... 62/246; 312/116
See application file for complete search history.

(56) References Cited

U.S. PATENT DOCUMENTS 2,198,436 A * 4/1940 Hoffman ..... A47F 3/043 312/139.2
3,350,152 A * 10/1967 Bang ..... A47F 3/043 312/323
3,712,005 A * 1/1973 Eschbach ..... B62D 33/046 52/210
3,911,245 A * 10/1975 O'Shaughnessy .... E06B 3/6715 219/218
4,248,015 A * 2/1981 Stromquist ..... A47F 3/0434 219/218
4,449,761 A 5/1984 Davis et al.
(Continued)

FOREIGN PATENT DOCUMENTS

DE 27 39 871 3/1978
DE 38 39 201 5/1990
(Continued)

OTHER PUBLICATIONS

International Search Report dated Jun. 25, 2013, corresponding to PCT/NL2013/050145.

*Primary Examiner* — Ljiljana V. Ciric
(74) *Attorney, Agent, or Firm* — Young & Thompson

(57) ABSTRACT

An access door for use in a cooling device for keeping products chilled and displaying them, in particular food and/or beverages, wherein the access door is substantially transparent and includes a first wall and a second wall parallel to each other, made of plastic, and joined at the edges to form a cavity between the walls.

6 Claims, 2 Drawing Sheets

(56) References Cited

U.S. PATENT DOCUMENTS 4,660,903 A * 4/1987 Shinagawa ..... A47F 3/0434 312/116
4,699,842 A * 10/1987 Jorgensen ..... C09J 4/06 428/343
4,962,865 A * 10/1990 Kakinuma ..... A47F 3/0404 220/592.04
5,058,393 A * 10/1991 Callon ..... A47F 3/0408 62/251
5,520,453 A * 5/1996 Aoki ..... E06B 3/7001 312/234
6,351,964 B1 * 3/2002 Brancheau ..... A47F 3/0408 211/59.2
6,406,108 B1 * 6/2002 Upton ..... A47F 3/001 312/116
6,506,108 B1 * 1/2003 Jagusch ..... A22C 15/005 452/193
7,043,886 B1 * 5/2006 Chubb ..... A47F 3/0434 312/138.1
8,162,414 B2 * 4/2012 Weiss ..... A47F 3/0434 312/138.1
2002/0093276 A1 * 7/2002 Kawakami ..... A47B 95/02 312/405
2003/0205059 A1 * 11/2003 Roche ..... A47F 3/0434 65/60.1
2008/0122324 A1 * 5/2008 Bienick ..... E05D 7/1011 312/116
2009/0021130 A1 * 1/2009 Weiss ..... A47F 3/0434 312/405
2009/0072679 A1 * 3/2009 Avila ..... E06B 3/025 312/116
2010/0180615 A1 * 7/2010 Linder ..... A47F 3/0434 62/248
2011/0100044 A1 5/2011 Reichert et al.
2012/0104909 A1 * 5/2012 Kaplan ..... F25D 23/02 312/204
2015/0014319 A1 * 1/2015 Norris ..... G06F 1/1626 220/324
2015/0040599 A1 2/2015 Veeneman et al.
2017/0191744 A1 * 7/2017 Koo ..... F25D 27/005
2017/0191745 A1 * 7/2017 Choi ..... H05B 37/0281
2019/0200784 A1 * 7/2019 Lee ..... A47F 3/001

FOREIGN PATENT DOCUMENTS

DE 20 2009 001138 5/2009
EP 2 833 780 B1 2/2018
FR 2 881 819 8/2006
GB 1 585 765 A 3/1981
GB 1585765 A * 3/1981 ..... A47F 3/0434
KR 10-0887575 3/2009
WO 03/071207 8/2003
WO 2013/133707 A1 9/2013

* cited by examiner

ACCESS DOOR FOR COOLING DEVICE WITH PRODUCT SPACE

BACKGROUND OF THE INVENTION

Field of the Invention

The present invention relates to a cooling device for keeping products chilled and displaying them, in particular food and/or beverages, comprising a product space conditioned by cooling means bounded on an entry side by an adjustable access door. The invention also relates to an access door of the type as used in a cooling device according to the present invention.

Description of the Related Art

Cooling devices are mainly used in supermarkets, department stores and other shops such as corner shops, petrol stations, self-service restaurants etc., to keep products inside chilled. For example, in order to keep products with a limited shelf life such as food and beverages fresh for longer, and to be able to offer certain products for immediate consumption chilled. This concerns mostly vertical cooling walls comprising a cupboard within which cooling means are provided in order to chill and keep chilled to a certain temperature a product space surrounded by the cupboard. Within the product space shelves are provided on which the products are exhibited as an offer to the public passing by. In order to offer the public passing by a good view of the exhibited goods, many original cooling devices are created to be open on the visible side. This however allows chilled air from the product space to circulate freely with warmer air from the surroundings, as a result of which effective and adequate cooling with the cooling means requires relatively large amounts of energy. In addition to higher energy costs for the shop concerned, this also forms a substantial burden on the environment.

Consequently, cooling devices have been made according to the type described in the opening paragraph, whereby the product space is bordered by a so-called day cover in the form of an adjustable access door at the entry side. The access door forms a partition which counteracts a free exchange of air between the product space and any surrounding air, and as a result helps to lower the consumption of the cooling device. The access door in known cooling devices is often mostly made of a glass plate. Such a glass plate can be transparent so as to hardly detract from a view of the exhibited goods in the cooling device. However, in view of the usual dimensions of the access door used in a cooling device the glass plate has to be relatively thick for a sufficiently reliable strength, which results in a heavy impractical whole.

A plate of plastic with corresponding dimensions has a significantly lower weight than its glass counterpart. Accordingly, a number of alternative cooling devices are known where the access door is chiefly made of a plastic plate. However, for a sufficiently stiff access door in which unwanted curvatures and other deformations through exposure to fluctuations in temperature and moisture or possibly its weight are prevented, it is apparent that a thickness of the plastic plate used nevertheless leads to a substantial total weight of the whole.

The present invention thus inter alia intends to provide a cooling device with an at least in this regard improved access door without compromising on its optical properties.

BRIEF SUMMARY OF THE INVENTION

In order to achieve the intended goal a cooling device of the type described in the opening paragraph is, in accordance with the invention, characterized in that the access door comprises an at least substantially multi-walled construction of an at least substantially plate-shaped first wall and an at least substantially plane-parallel second wall, each of the walls comprising at least substantially a flat edge part all around with which both walls are interconnected and that both walls mutually hold a cavity between the edge parts. The invention is moreover based on the insight that multi-walled constructions consisting of walls attached to each other at the edge parts with an enclosed cavity space, a kind of box structure as it were, not only offers very good stiffness to the access door so no deformation takes place, but due to the presence of the cavity also insulates well and reduces condensation on the transparent access door. Consequently, due to its high stiffness the access door needs less material, so that it can be made with a relatively light weight, whereas good visibility of the goods exhibited in the product space of the cooling device is maintained in almost all cases.

Within the context of the invention a preferred embodiment of the cooling device according to the invention is characterized in that at least one of both walls comprises a central part at the location of the cavity which is offset from the edge part and borders the cavity. Accordingly, the wall concerned can be made of an at least almost completely flat central part, whereby a part of the wall extending from the central part comprises the edge part to be attached to an edge part of the other of the walls while enclosing the cavity. The other of the walls can thus be made completely flat so that production costs can be reduced. Although either one of the walls can be chosen as the completely flat wall, the other wall say comprising the offset central part, the access door is aesthetically at its most attractive with a completely flat wall on the visible side of the access door. Consequently the cooling device according to the present invention in a special embodiment is characterized in that the first wall is at a visible side of the access door and is at least almost completely flat and that the second wall comprises the central part offset from the edge part.

A total thickness of the construction of the access door is preferably adapted to the usual dimensions for use of such doors, so that the access door according to the present invention can be used with already existing or commonly used furniture and locking means. Within this total thickness a thickness of the cavity is preferably a minimum of 8 mm for good insulation. A remaining thickness of the door can be variably attributed to the walls. Thus both walls can for example be made with a uniform wall thickness. However, in a further preferred embodiment the cooling device according to the present invention is characterized in that the first wall on the visible side mainly has a wall thickness thicker than a wall thickness of the second wall. The wall on the visible side of the door is after all often the most intensively influenced. Passers-by for example unexpectedly knock against it with body parts or objects such as shopping baskets and trolleys. By giving the wall on the visible side in particular a relatively large wall thickness within the desired total thickness of the door the risk of harm to the wall such as cracks, fractures or other types of serious damage, is decreased. Furthermore, at least on the visible side the access door can be optionally provided with a scratch resistant transparent layer of coating in order to reduce scratches or other surface damage.

In a further preferred embodiment the cooling device according to the present invention is characterized in that at least one of both walls is made of plastic, in particular of a plastic chosen from a group of polymethylmethacrylate (PMMA), such as high impact PMMA, extruded PMMA or cast PMMA, polycarbonate (PC) and polyethylene terephthalate glycol (PETG). In addition to favourable weight savings the walls of plastic offer a further improvement by reducing condensation through good heat absorption of the material. The plastics mentioned specifically moreover have good transparent properties, so that a clear and bright view of the products offered in the cooling device is maintained.

A special embodiment of the cooling device according to the present invention is characterized in that both walls are made of the same plastic. This is not only beneficial in practical terms but also enables a good and reliable attachment between the walls with a suitable adhesive. Accordingly in a further preferred embodiment according to the present invention the cooling device is characterized in that the walls are attached to each other with a transparent adhesive, in particular with a transparent acrylate adhesive, provided between the edge parts. By using a transparent adhesive the access door remains at least almost fully transparent, even at the edge parts, whereas an acrylate adhesive is moreover capable of attaching the walls of acrylate so strongly that additional clamping or closing means or door frames around the circumference of the access door are unnecessary.

In a further preferred embodiment according to the present invention the cooling device is characterized in that at least one of the walls is provided with one or more ventilation openings for ventilation between the cavity and the surrounding air, and in a particular embodiment according to the present invention is characterized in that the ventilation openings at a side of the walls facing the cavity is partly closed off with a ventilating closure member. The ventilation openings enable a ventilation of the cavity space, so that condensation on the access door is further reduced without having to comprise to much on the insulating capability of the door. In particular by using a ventilating closure device an air pressure and air temperature in the cavity space can also be adjusted at will. Condensation can be prevented particularly well when the ventilation openings are provided for in the wall at the product space side of the access door by exchanging air in the cavity with cooler drier air from the product space.

A further preferred embodiment of the cooling device according to the present invention is characterized in that a light source is provided for in the cavity which is capable of illuminating at least a visible side of the access door. The light source can be used to attract the public passing by and to direct their attention more towards the products exhibited in the cooling device, while heat emitted from the light source is screened off from the product space by placing it in the cavity. Although every known type of light source can be used, the cooling device in a further preferred embodiment according to the present invention is characterized in that the light source comprises LED-lighting and in particular consists of one or more LED-strips. LED-lighting and in particular LED-strips are particularly good for placement in the cavity of the access door due to their relatively modest dimension and due to their favourable energy consumption, making a permanent connection to a power network unnecessary.

In a further preferred embodiment according to the present invention the cooling device is characterized in that the access door is provided with prints. This can for example be a promotional text or an image or an indication of price or other types of information. However in a particular embodiment according to the present invention the cooling device is characterized in that the prints comprise a camouflaging decorative print which is provided at least between the edge parts at a side of the first wall facing the cavity. Consequently a potentially less attractive connection between the edge parts as a result of the adhesive provided between them is removed from view, so that a view of the access door from the visible side thus remains particularly appealing regardless. Moreover the prints cannot be affected from the outside due to use on the side facing the cavity so that they remain attractive for a long period of time. When using a light source in the cavity the camouflaging decorative prints can also be used to remove the light source and fittings used from view behind the prints, so that only the light emitted from the light source remains visible.

In a preferred embodiment an access door of the type as used in the cooling device according to the present invention is provided with suspension means on at least two corner points of the walls. Consequently an at least almost completely prefab access door can be produced to be attached quickly and efficiently to the cooling device on-site.

BRIEF DESCRIPTION OF THE DRAWINGS

The invention will now be explained in more detail based on an example of an embodiment and an associated drawing. The drawing shows.

The figures are purely schematic and not drawn to scale. In particular some of the parts and dimensions are represented in a more or less exaggerated matter for the sake of clarity.

DETAILED DESCRIPTION OF THE PREFERRED EMBODIMENTS

Figure 1A:
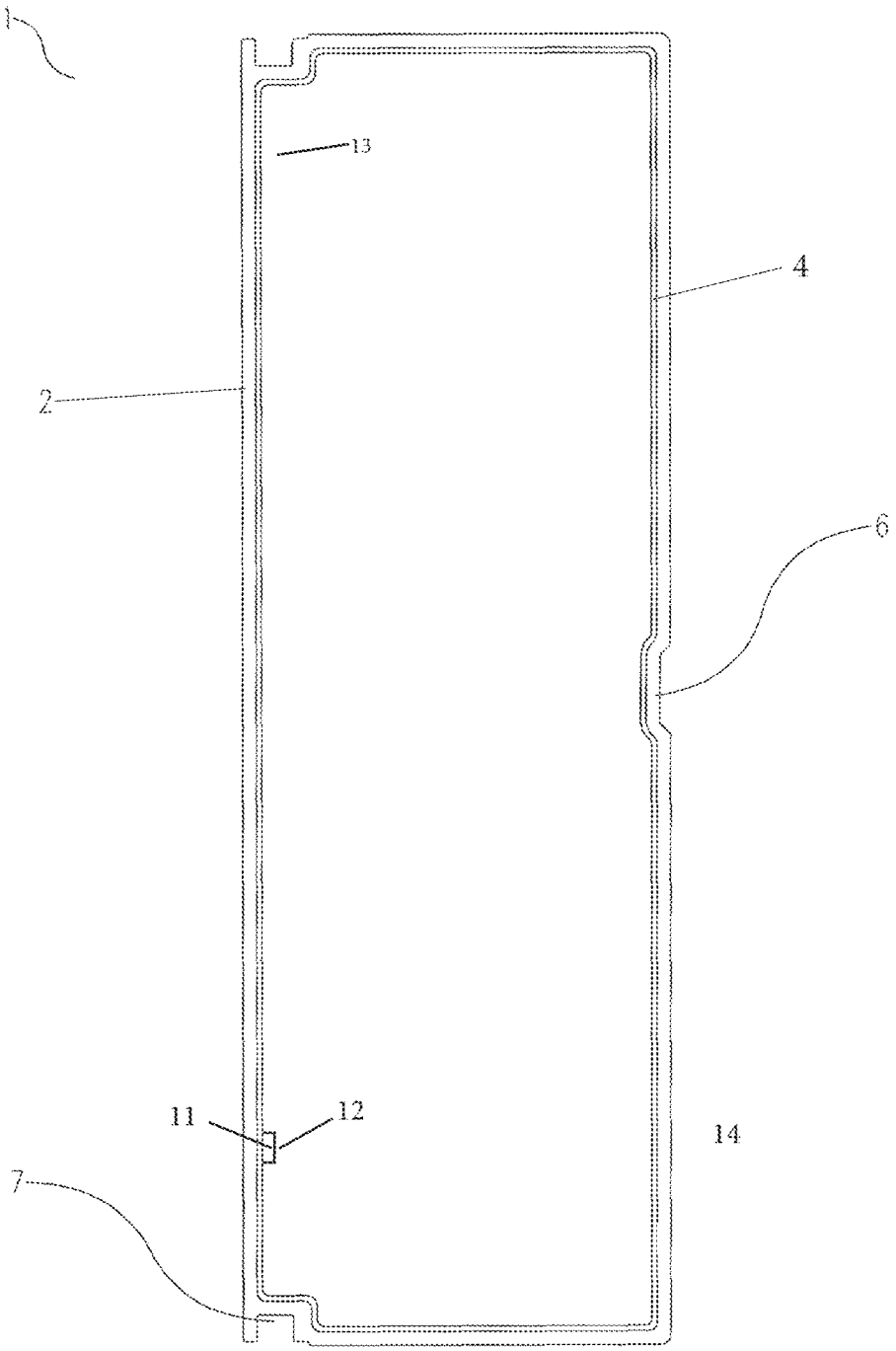
FIG. 1A a front view of an example of the embodiment of an access door according to the present invention.
Figures 1B, 1C:
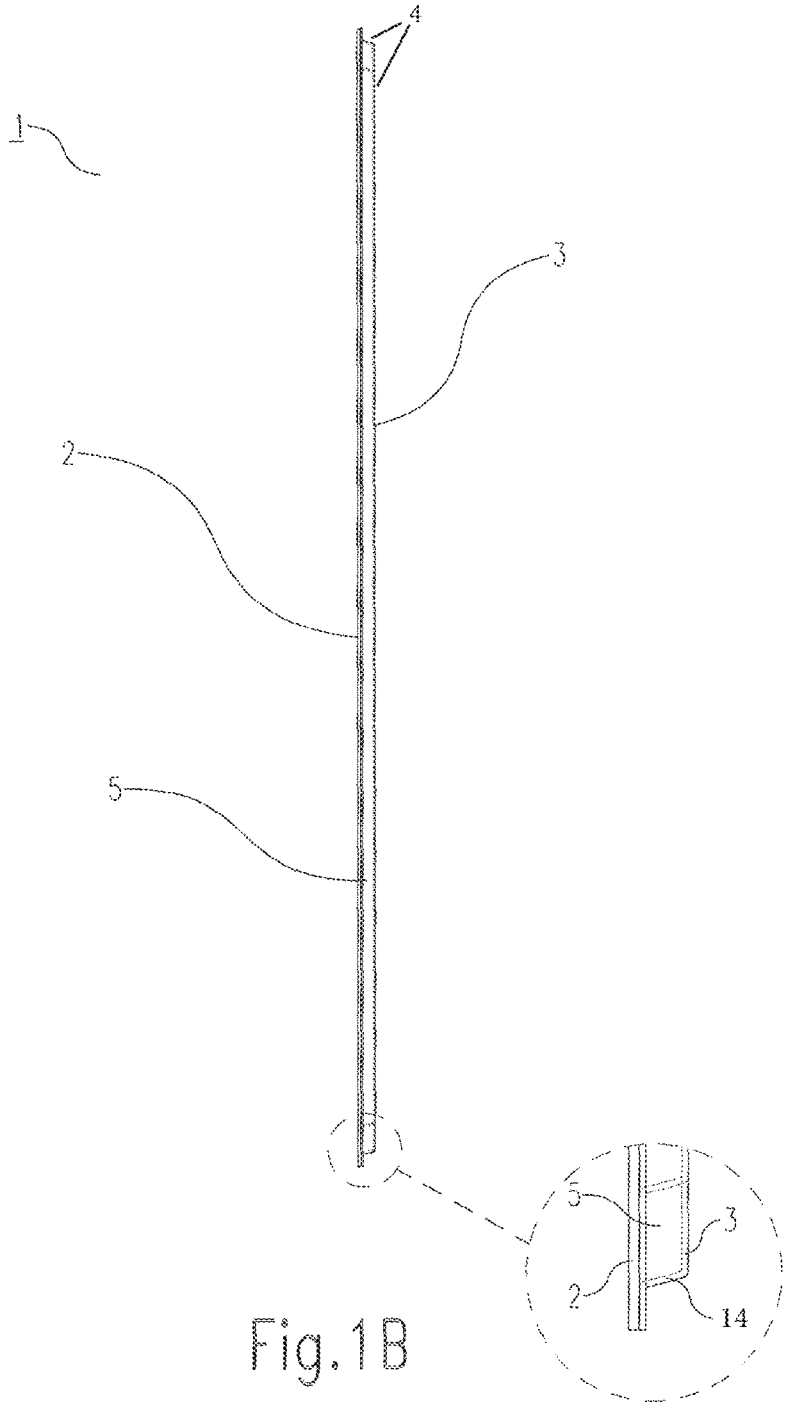
FIG. 1B a side view of the example of the embodiment of an access door according to the present invention.
FIG. 1C a detailed view of the example of the embodiment of an access door according to the present invention.

As shown in FIG. 1A up to and including FIG. 1C an access door (1) for use in a cooling device (8) according to the present invention comprises a completely uninterrupted first plate-shaped wall (2) of plastic at an exterior visible side. The first wall (2) is moreover made of cast polymethylmethacrylate (cast PMMA), which is a particularly suitable plastic for use in the access door of a cooling device due to its good transparency. With its own flat edge part the first wall (2) is attached to an edge part of a plane-parallel second wall (4) which is also fully made of cast polymethylmethacrylate. FIG. 1B shows the access door (1) suspended at that the opening of the cooling device (8), The second wall (4) comprises a substantially flat central part (3) which is offset from the edge part to leave room for a cavity (5) bounded by the walls. Consequently, the second walls forms as it were a box-shaped body with a flat edge part against which the first wall is easily attachable, for example, by using an adhesive connection (10), shown schematically in FIG. 1C. In this example of an embodiment the PMMA walls are attached using a transparent acrylate adhesive so that even a connection between the walls remains at least almost transparent. As shown in FIG. 1A the access door comprises a gripping part (6) at the length side enabling a user to easily grasp the access door with a hand in order to adjust the access door, for example to move the door from a closed position shutting off the product space to an open position in order to take a product out of the product room. The gripping part (6) is formed by a recess in the length side of both the first as well as the second wall. The access door also comprises a corner profile (7) for a relatively simple joining of the hinge means to install the access door as a hinge door in the cooling device.

One of the first and second walls (2, 4) is provided with one or more ventilation openings (11) (shown schematically in (FIG. 1A) for ventilation between the cavity and surrounding air. FIG. 1A also schematically shows the one or more ventilation openings (11) being partly closed off with a ventilating closure member (12) located at the side of the second wall (4) facing the cavity (9). FIG. 1A additionally schematically shows a light source (13) provided in the cavity. The light source (13) is capable illuminating at least the exterior, visible side of the access door. FIG. 1A schematically shows the access door provided with prints (14). FIG. 1C shows the edge part of the second wall (4) connected, via a connecting part (14), to the central part at the location of the cavity.

An attachment of the first wall (2) against a box-shaped second wall (4) results in a very stiff box-shaped construction which prevents a deformation of the access door with relatively little material. The access door is thus particularly light in weight. Moreover, the presence of a cavity space provides further improved insulation capability of the access door and reduces the appearance of condensation, undoubtedly also due to the use of plastic walls.

Although the invention was described in more detail solely using this one single example of an embodiment it should be clear that the invention is certainly not limited to this. On the contrary, in the context of the invention many variations and embodiments are available to the average person skilled in the art.

The invention claimed is:

1. An access door for use with a cooling device having a product space for keeping products chilled and displaying them, including food and/or beverages, the access door comprising:

transparent first wall;

a transparent second wall;

both the first wall and the second wall having a respective central part, wherein the central parts of both walls are flat and are parallel to each other;

the first wall having a first edge part with an inner perimeter and an outer perimeter that defines an outermost perimeter of the first wall, the second wall having a second edge part with an inner perimeter and an outer perimeter that defines an outermost perimeter of the second wall, the first and second edge parts both having respective flat parts at the respective outermost perimeters, the flat part of said first edge part of said first wall being directly adhered to the flat part of said second edge part of said second wall to thereby join said first wall and said second wall, wherein the central part of the first wall is offset from the central part of the second wall thereby defining a cavity between said first wall and said second wall, wherein said first wall and said second wall are made of plastic, and wherein a recess is formed in a longitudinal side of both the first wall and the second wall, said recess providing a gripping part that enables a user to grasp and adjust the access door.

2. The access door according to claim 1, wherein one of the first wall and of the second wall includes one or more ventilation openings for ventilation between the cavity and surrounding air outside the cavity.

3. The access door according to claim 2, wherein one or more ventilation openings are provided in said second wall, the one or more ventilation openings configured to allow exchanging air in the cavity with cooler drier air outside the cavity.

4. An access door for a cooling device for keeping products chilled and displaying the products, the cooling device including a conditioned product space with an opening defining a product entry side of the product space, the access door comprising:

a transparent first wall;

a transparent second wall;

both the first wall and the second wall having a respective central part, wherein the central parts of both walls are flat and are parallel to each other;

the first wall having a first edge part that defines an inner perimeter and a flat outermost perimeter of the first wall, the second wall having a second edge part that defines an inner perimeter and a flat outermost perimeter of the second wall, the flat outermost perimeter of the first edge part of the first wall being directly adhered to the flat outermost perimeter of the second edge part of the second wall, the central part of the first wall being offset from the central part of the second wall, thereby defining a cavity between said first wall and said second wall, the access door being configured such that when it is installed on the cooling device, the opening of the product space is bound by the access door, with the access door in an open position, the opening of the product space is open, and with the access door in a closed position, the opening of the product space is closed, and wherein a recess is formed in a longitudinal side of both the first wall and the second wall, said recess providing a gripping part that enables a user to grasp and adjust the access door.

5. The access door according to claim 4, wherein one of the first wall and of the second wall includes one or more ventilation openings for ventilation between the cavity and surrounding air outside the cavity.

6. The access door according to claim, 5, wherein, the first wall is located at an outer side of the access door and is flat from a top edge to a bottom edge and from a first side edge to an opposite, second side edge.

* * * * *